US005927743A

United States Patent [19]

Mantel

[11] Patent Number: 5,927,743

[45] Date of Patent: Jul. 27, 1999

[54] GLIDING BOARD EQUIPPED WITH A DEVICE INTENDED TO MODIFY THE STIFFNESS OF THE BOARD UNDER THE EFFECT OF A VERTICAL THRUST EXERTED BY THE USER

[75] Inventor: Denis Mantel, Brignoud, France

[73] Assignee: Skis Rossignol S.A., France

[21] Appl. No.: 08/755,555

[22] Filed: Nov. 22, 1996

[30] Foreign Application Priority Data

Dec. 19, 1995 [FR] France ..... 95 15457

[51] Int. Cl.[6] ..... A63L 5/07

[52] U.S. Cl. ..... 280/602

[58] Field of Search ..... 280/602, 607, 280/617, 618

[56] References Cited

U.S. PATENT DOCUMENTS

| | | | |
|---|---|---|---|
| 3,260,532 | 7/1966 | Heuvel . | |
| 3,689,096 | 9/1972 | Ribi | 280/613 |
| 5,242,188 | 9/1993 | Bigler et al. | 280/618 |
| 5,333,889 | 8/1994 | Piegay et al. | 280/602 |
| 5,704,628 | 1/1998 | Boehm et al. | 280/602 |

FOREIGN PATENT DOCUMENTS

| | | | |
|---|---|---|---|
| 0230989 | 8/1987 | European Pat. Off. . | |
| 2109654 | 5/1972 | France . | |
| 2639-242 | 5/1990 | France | 280/602 |
| 389-384 | 9/1990 | France | 280/602 |
| 2684885 | 6/1993 | France . | |
| 2686798 | 8/1993 | France . | |
| 2686799 | 8/1993 | France . | |
| 2690079 | 10/1993 | France . | |
| 2695041 | 3/1994 | France . | |
| 2702386 | 9/1994 | France . | |
| 2713945 | 6/1995 | France . | |
| WO 83/03360 | 10/1983 | WIPO . | |
| WO 95/00217 | 1/1995 | WIPO . | |

*Primary Examiner*—Lanna Mai
*Assistant Examiner*—Avraham H. Lerner
*Attorney, Agent, or Firm*—Parkhurst & Wendel, L.L.P.

[57] ABSTRACT

A gliding board is equipped with, in a binding and boot support region, a stiffener device to modify the stiffness of the board under the effect of a thrust, exerted by a user, toward the upper face of the board, wherein the stiffener device includes: an elongate upper platform to accommodate a boot binding on its upper face, the front end of the platform being secured to a point linked to the board; a rigid and nondeformable intermediate stud of fixed height located between the lower face of the platform and the upper face of the board; and means for stretching at least one part of the board under the action of a vertical thrust exerted in the rear region of the platform.

18 Claims, 4 Drawing Sheets

3
4
22

10
11
2
15
21
20
e1
1
5
12
13
14
17
24
23
d1

F1
10
2
12
14
21
20 e2
1
16
d2
A
B

F2
2
12
22
20 e3
1
15
17
d3
29

GLIDING BOARD EQUIPPED WITH A DEVICE INTENDED TO MODIFY THE STIFFNESS OF THE BOARD UNDER THE EFFECT OF A VERTICAL THRUST EXERTED BY THE USER

TECHNICAL FIELD

The invention relates to the field of sports involving gliding on snow. It relates more particularly to gliding boards equipped with a device, interposed between the binding and the top of the board, making it possible to adapt the characteristics of the board interactively to the various positions and magnitudes of the impulsive forces which occurs when practicing the sport, in particular when making a turn.

The invention will be described below as regards its more particular application to alpine skiing, but without excluding other snow gliding sports, such as monoskiing or snowboarding, from the scope of the invention.

PRIOR ART

Since the invention aims in particular to optimize the response of a ski when making a turn, the various phases and the positions of the forces transmitted by the skier to the ski during a turn should first be specified. Very schematically, a turn can be divided into three essential phases, namely initiation, execution and exiting the turn.

During the phase of initiating the turn, the skier shifts his bodyweight into the turn and forward. The ski must then bend in order for its inner edge to be described by a curve. In order to reduce the radius of curvature of this trajectory, the skier's impulse, that is to say the force which he exerts on the ski, should be greater than for making a large-radius turn. It has been observed that the impulse exerted may reach a force corresponding to five to eight times the skier's weight. In order to make it easier to curve the ski during this initiation phase, it is necessary for the ski to be sufficiently flexible and for the skier's load to be applied substantially pointwise onto the ski, in order to attain a short ski response.

During the phase of executing the turn, the skier's position moves back, so that his bodyweight is applied substantially at the middle of the boot. The ski maintains its radius of curvature in this phase.

Finally, when exiting the turn, the skier displaces his bodyweight rearward, and the region where the skier bears on the ski is therefore displaced in the direction of the boot heels. During this phase, it is preferable to have a stiffer ski, responding as a longer ski in order to improve its stability. The skier's weight should be distributed over the maximum length of the ski in this phase.

It is therefore seen that the ski should ideally respond as a very flexible short ski when initiating and executing the turn, then convert to a long, stiff ski for the running phase.

Document FR-A-2,702,386 of the applicant describes a hydraulic device which, as a function of the front or rear location of the skier's thrust, makes it possible to modify the overall stiffness of the ski. Although satisfactory and giving appreciated results, this solution needs to be installed within the thickness of the ski, which requires relatively complex operations with poor economic viability.

Documents FR-A-2,684,885, FR-A-2,686,798, FR-A-2,686,799, FR-A-2,690,079 and FR-A-2,713,945 have also proposed devices intended to modify the natural pressure distribution of a ski on its gliding surface.

These devices are installed under the sole of the boot, between the toe piece and the heel piece of the binding and make it possible to exert a tension on the ski, via a system of arms, levers and rockers actuated when fitting the boot to the binding. However, these devices require a large number of parts which have articulation axles which are subjected to particularly high stresses and are therefore fragile, especially under working conditions (moisture and cold) and also generate mechanical play. In addition, they do not dynamically modify the stiffness of the ski as a function of the skier's position. They provide no substantial variation in the thickness of the ski during use, according to the location of the pressures exerted by the skier. These devices modify the stiffness of the ski and its camber as soon as the boot is fitted to the binding, solely by applying load to the heels of the boots.

The problem which the invention is intended to solve is to provide a ski whose stiffness changes dynamically during the various phases of a turn. The desired aim is to give the ski a response equivalent to that of a short, flexible ski during forward pressure at the start of a turn, and alternately the response of a long, stiff ski during the rear pressure which takes place for the final phase of the turn.

DESCRIPTION OF THE INVENTION

The invention relates to a gliding board namely, for example, an alpine ski, a cross country ski, a monoski or a snowboard, having a lower gliding face and an upper face intended, in the support region, to accommodate a binding which can secure the user's boot to the board, the board being, in the support region, equipped with a stiffener device intended to modify the stiffness of the board under the effect of a thrust exerted by the user toward the upper face of the board.

The gliding board according to the invention is one wherein the stiffener device includes:

- an elongate upper platform intended to accommodate the binding on its upper face, the front end of said platform being secured to a point linked to the outer surface of the board;
- a rigid and nondeformable intermediate stud, of fixed height, arranged between the lower face of the platform and the upper face of the board, separating the platform into a front region and a rear region ;
- means intended to stretch at least one part of the board under the action of a vertical thrust exerted in the rear region of the platform.

In other words, the board accommodates a platform interposed between the binding and the top of the board, this platform acting on the board in order to generate a different response depending on whether the user's pressure is located toward the front or toward the rear. Thus, when pressure is directed forward, the platform is used as a simple rising intermediate and transmits the forces, on the one hand via the front bearing point and, on the other hand, via the intermediary stud located substantially level with the instep of the boot. The skier's load is thus distributed over a short region and could be likened to a point load.

On the other hand, in the event of pressure located to the rear of the intermediate stud, the platform transmits, further to a load perpendicular to the sole, two opposite longitudinal components which have the effects of tensioning the ski between the two bearing points of these components, and therefore of increasing the stiffness of the ski in this region. During this phase, therefore, the skier's load is thus distributed over a relatively longer region than in the preceding phase.

In other words, and in summary, when the pressure is to the rear, the ski responds more stiffly than when the pressure is to the front.

As regards the intermediate stud, it is necessarily rigid in order to constitute a bearing region for the platform. In a first embodiment, it is secured to the upper face of the board and the lower face of the platform slides on the upper face of the stud. In a second embodiment, the stud is secured to the lower face of the platform and the lower face of the stud can slide on the upper face of the board. It is typically located substantially level with the middle of the boot, that is to say in the boundary region between the front and rear pressure.

To solve the problem of balancing the response of the platform as a function of the precise location of the front and rear pressure, the intermediate assembly includes means for adjusting the longitudinal position of the stud relative to the board and/or the platform.

In a first embodiment, the means intended to stretch a part of the board consist of a set of cam surfaces arranged respectively under the lower face of the platform and on the upper face of the board, said. cam surfaces being oriented downward and toward the front of the board, so as to cause the bearing point of the front of the platform (A) to move away from the bearing point of the cams (B), under the effect of a thrust, perpendicular to the surface of the board, exerted in the rear region of the platform.

Thus, when the pressure is to the rear, the opposing cam surfaces slide relatively to one another which, in view of their inclination and the rigidity of the platform, cause the anchoring point of the cam secured to the ski (B) to move slightly away from the bearing point of the front end of the platform (A) . In this way, the support region of the ski is stretched or tautened by virtue of the platform.

The function of the cam surfaces is therefore to convert the vertical displacement, generated by the impulse exerted by the skier when the turn is initiated, into horizontal components generating tension under the support region. This thrust force therefore leads to an increase in the initial stiffness of the ski in the support region, and therefore a sensation of a longer ski because the load is distributed over the length of the supports.

In practice, at least one of the cam surfaces advantageously consists of an inclined slope, the inclination of which relative to the upper surface of the board is between 30 and 60 degrees, and more precisely close to 45 degrees.

In another advantageous embodiment, one of the cam surfaces consists of a cylindrical roller whose axis of revolution is perpendicular to the longitudinal mid-plane of the board.

In a more sophisticated form of the invention, this roller is mounted so as to rotate about its axis of revolution in order to reduce the effects of friction. Moreover, again to reduce the friction phenomena, the opposing cam surfaces are covered with a coating intended to reduce the coefficient of friction, typically a polytetrafluoroethylene layer.

In order to prevent excessive motion, the stiffener device comprises a stop which can limit the displacement of the rear end of the platform upward and rearward. Thus, when the pressure is at the front, the platform tends to lift at the rear. This characteristic stop therefore makes it possible to prevent the rear end of the platform from rising excessively.

In a preferred form of the invention, the stiffener device comprises a strip of viscoelastic material interposed between said stop and the rear end of the platform, in order to damp these displacements.

In a variant, an elastic return element may be housed under the rear part of the platform, between the top of the board and the lower part of the platform. This elastic element may be a mechanical spring (coil or leaf spring) or a stud made of elastic material (for example rubber).

The plate constituting the platform should be rigid enough to transmit, without buckling, the longitudinal forces intended to stretch the support region of the board. This plate may either be metal or made of a composite material reinforced with glass, carbon or Kevlar® fibers, or made of a reinforced plastic.

In a second embodiment of the invention, the means intended to stretch a part of the board consist of an arm located at the rear of the platform, the front end of which is articulated to the rear of the platform, the rear end of the arm bearing on a fixed point of the upper face of the board and pushing it back under the effect of a vertical thrust exerted in the rear region of the platform.

The fixed bearing point of the rear end of the arm may either be a notch located in the upper part of the ski or a stop formed or fitted on the ski.

In other words, the platform has a rear extension which is articulated so that, when the pressure is to the rear, that part of the platform lying between the intermediate stud and its rear end flexes, with the effect of opening the angle $\alpha$ formed by the end of the platform and the arm, and thereby moving said fixed point (A), corresponding to the front end of the platform, away from the rear fixed point (C) linked with the upper surface of the ski, which causes the support region to be tensioned.

In an advantageous form, the rear end of said arm is articulated onto the upper face of the board, in particular by means of an intermediate part.

In a third embodiment, the means intended to stretch a part of the ski also comprise a second arm, forming a hinged fork with the first, the front end of this second arm bearing on a second fixed point (D) of the upper face of the board, these two fixed points being moved away from one another under the effect of a vertical thrust exerted in the rear region of the platform.

In other words, the rear portion of the platform bears on a hinged fork which forms a stay and, when it is compressed during the rear pressure phases, tensions the support region between the bearing points (C) and (D).

BRIEF DESCRIPTION OF THE FIGURES

The way in which the invention is embodied, and the advantages which result therefrom, will emerge clearly from the following description of embodiments, supported by the appended figures, in which.

For the sake of simplicity, it will be assumed below that the board described is laid on a horizontal plane, so that the direction of the impulses exerted by the skier corresponds to the vertical direction.

EMBODIMENTS OF THE INVENTION

As already mentioned, the invention relates to a gliding board, in particular a ski, which includes a device making it possible to stiffen said ski as a function of the front or rear position of the thrust exerted by the skier. As already seen, several architectures make it possible to achieve the desired result.

In all its embodiments, the invention is in the form of a platform (2) which is intended to accommodate, at the front, the toe piece (3) and, at the rear, the heel piece (4) of the boot binding and which is positioned substantially level with the support region of the ski (1).

As already mentioned, the invention relates to a gliding board, but it will be described in detail below with regard to its application to an alpine ski.

First Embodiment of the Invention

Figure 1:
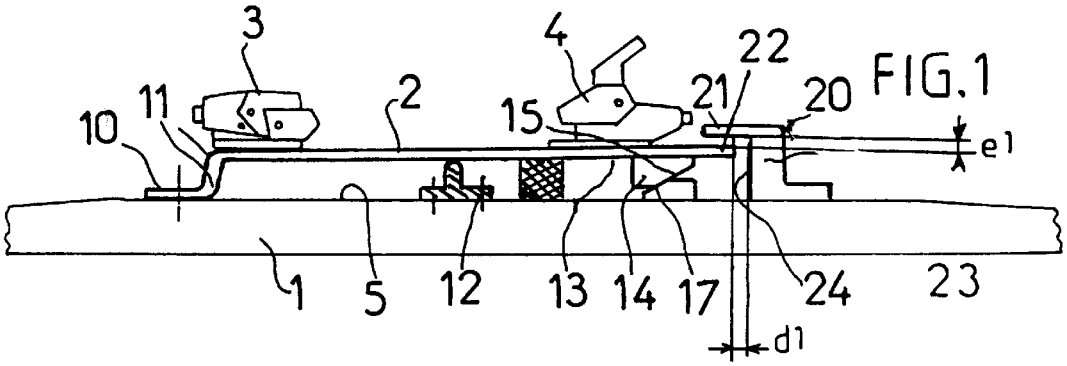
FIG. 1 is a side view of a first embodiment of the invention, shown in the neutral position.

As seen in FIG. 1, the intermediate stiffener device according to the invention is in the form of an elongate platform (2) which has its front end (10) secured to the upper face (5) of the ski (1) , by means of suitable curves (11).

In its central region, substantially level with the middle of the boot, the platform (2) has an interposed rigid stud (12), interposed between the platform (2) and the upper face (5) of the ski. As already mentioned, this stud (12) may be fixed on the upper face (5) of the ski and support the sliding of the lower face of the platform, or vice versa.

In an advantageous form, it is possible to adjust the longitudinal position of this stud (12) as a function: of the total length of the platform (2), of its position on the ski, of the position of the bindings on the platform, and of the front/rear distribution of the pressure (F1, F2).

In the rear region, the lower face (13) of the platform (2) accommodates a wedge (14) which has a sloped face (15) oriented forward and downward.

This sloped wedge (14) faces a second sloped wedge (16) fixed on the upper face of the ski. Symmetrically, the slope (17) of this second wedge (16) is also oriented downward and toward the front of the ski.

The upper face (5) of the ski accommodates a stop (20) forming a corner piece whose horizontal branch (21) covers the rear end (22) of the platform (2) in order to limit its upward motion.

Typically, at rest, that is to say when the platform supports only the skier's weight without any impulse, the distance ($e_1$) between the upper face of the platform (2) and the horizontal branch (21) of the corner piece is 2 millimeters, while the front face (24) of the vertical branch (23) of the corner piece is separated ($d_1$) by about 5 millimeter from the rear end (22) of the platform (2).

Figure 3:
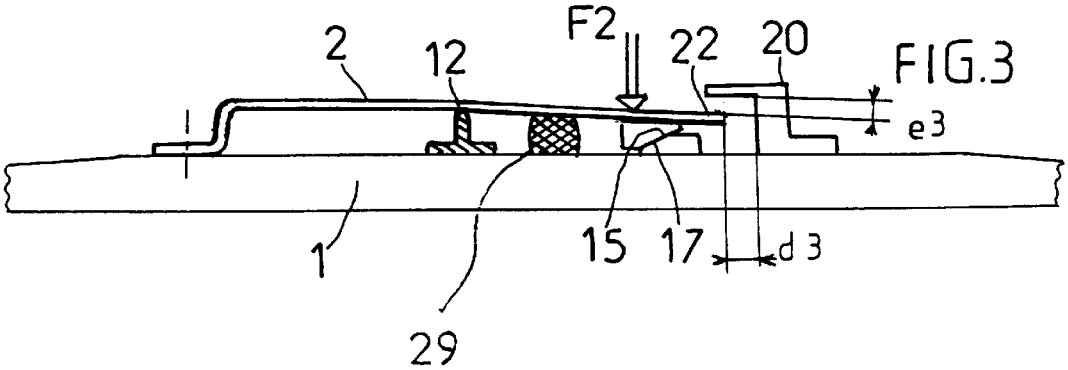
FIG. 3 is a side view of the same device, shown with rear pressure.
Figure 3A:
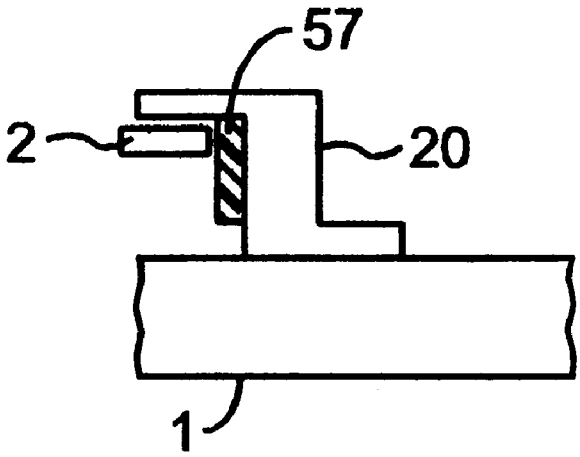
FIG. 3A is a partial view like that of FIGS. 1–6, additionally illustrating a variant embodiment including strip 57 of viscoelastic material.

In a variant, shown in FIG. 3A, a strip 57 of viscoelastic material, intended to make the motion progressive, may be arranged in this rear region between the rear end of the platform (22) and the stop (20).

Figure 4:
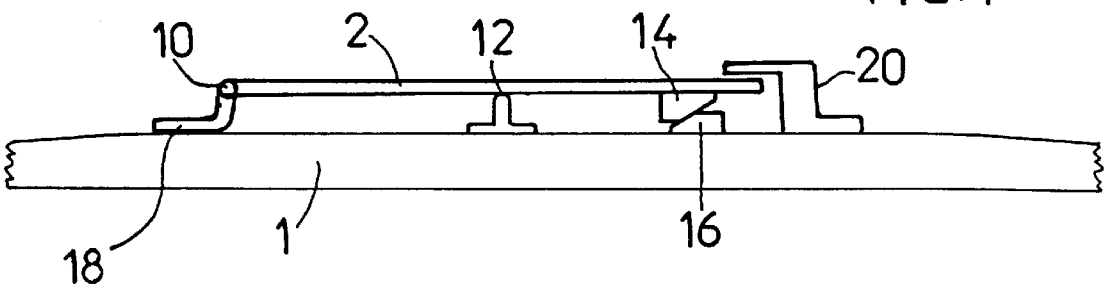
FIG. 4 is a side view of a first alternative embodiment of the invention.

In a variant of this first embodiment, the front end (10) of the platform (2) is articulated onto an intermediate part (18), itself fixed on the upper face of the ski (cf. FIG. 4).

Figure 5:
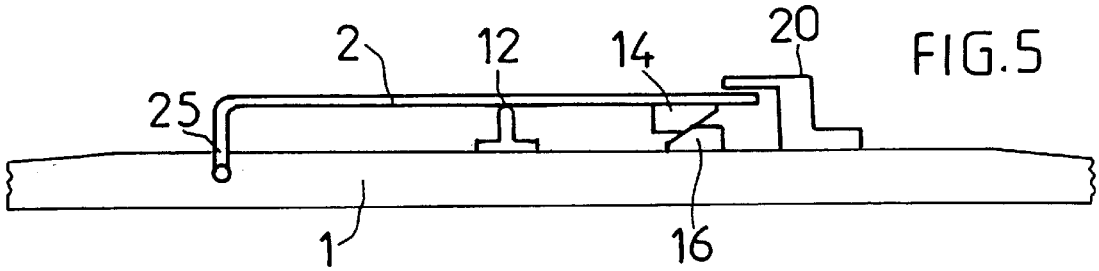
FIG. 5 is a side view of another variant, relating to the front articulation of the platform.

In another variant, illustrated in FIG. 5, the front end of the platform has vertical extensions (25) which are articulated directly onto the board, in particular level with its sides.

Figure 6:
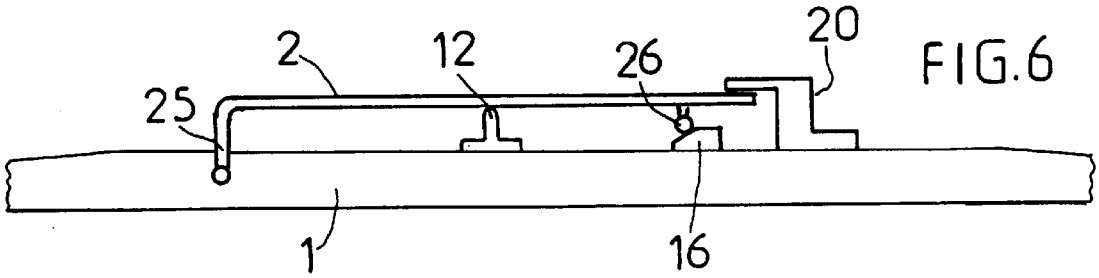
FIG. 6 is a side view illustrating an alternative embodiment in which one of the cam surfaces is produced by a roller.

The invention is not limited to the cam surfaces described in FIGS. 1 to 5, and they may clearly adopt any other advantageous form, in particular that of a cylindrical roller (26) rolling on a cam 16, as illustrated in FIG. 6.

In addition, the cam surfaces which are in contact may advantageously be covered with a surface which facilitates sliding and reduces the coefficient of friction.

It may also prove beneficial to interpose a stud (29) of elastic material, making it possible to return the device to the initial position, between the rear part of the platform (2) and the upper face (5) of the ski.

This first embodiment functions as follows.

Figure 2:
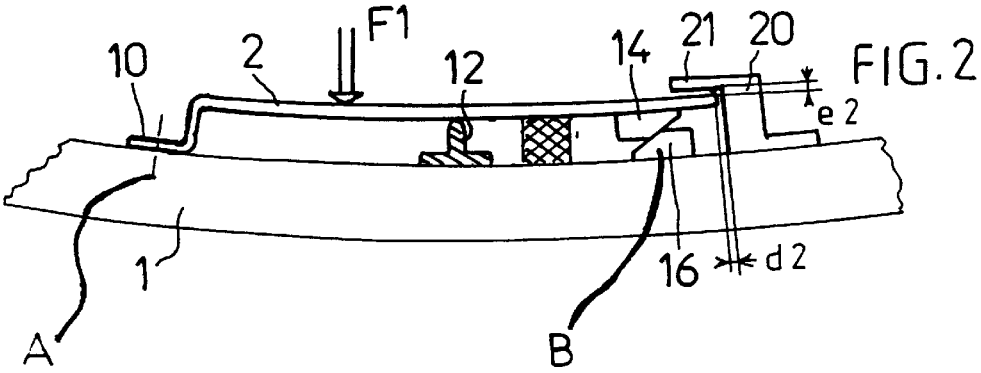
FIG. 2 is a side view of the same embodiment, shown with forward pressure.
Figure 2A:
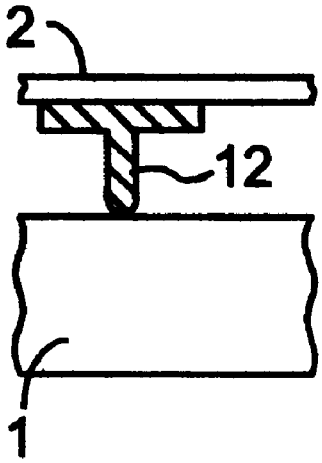
FIG. 2A is a partial view like that of FIGS. 1–3, but illustrating a second embodiment in which stud 12 is secured to the lower face of platform 2.

The neutral position, corresponding to the state in which the platform (2) is merely subjected to the effect of the skier's weight, is illustrated in FIG. 1. FIG. 2 shows the deformations generated by an impulse (F1) located at the front, which may reach the equivalent of six to seven times the skier's weight.

In this case, the front part of the platform (2) rests on its front articulation (10) , and on the intermediate stud (12) in the central part. In this way, the forward pressure (F1) is transmitted by these two connecting regions (10, 12) from the platform (2) to the ski (1).

Subsequently, with rear pressure (F2), the rear part of the platform (2) has the two sloped wedges (14, 16) which slide relative to one another. In view of the downward and forward orientation of the two slopes (15, 17), the stiffness of the platform (2) causes tensioning between the points (A) and (B), stretching to the support region of the ski. In this way, the stiffness of the platform (2), with which the stiffness of the boot is of course combined, adds to the stiffness of the ski (1) in the support region. The response of the board thus corresponds to that of a longer ski which, as expected, improves stability at the end of the turn.

Level with the rear wedge (20), flexing of the platform (22) due to the forward pressure (F1) causes the rear end (22) of the platform (2) to move closer ($e_2<e_1$; $d_2<d_1$) respectively to the horizontal part (21) and the vertical part (24) of the stop (20).

In contrast, with rear pressure (F2), the rear end (22) of the platform tends to descend and move away ($e_3>e_1$; $d_3>d_1$) from the stop (20).

Second Embodiment of the Invention

Figure 7:
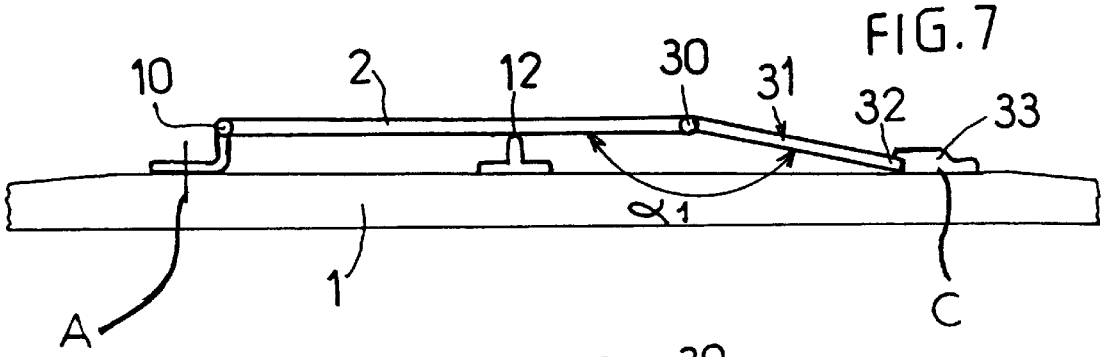
FIG. 7 is a side view of a second embodiment of the invention, shown in the neutral position.
Figure 8:
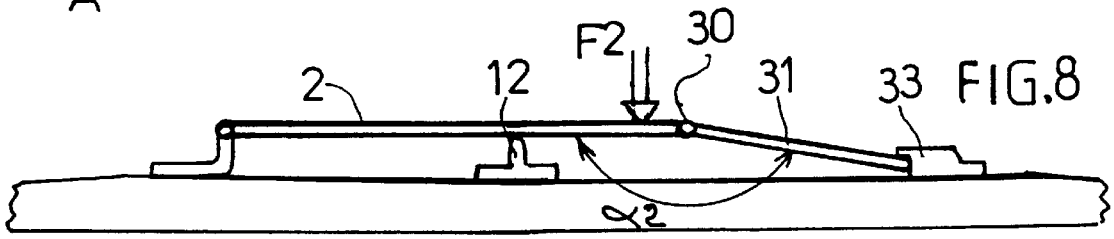
FIG. 8 is a side view of the same device, shown with forward pressure.

FIGS. 7 and 8 illustrate an embodiment of the invention in which, in its rear region, the platform has an articulation (30) with an arm (31) forming a rearward extension. The rear part (32) of this arm bears on a transverse stop (33) secured to the upper face (5) of the ski. Thus, with rear pressure (F2), the flexing of the rear of the platform (2) tends to open the angle $\alpha$ ($\alpha_2>\alpha_1$) and the rear end (32) of the arm therefore pushes the stop (33) back. The support region is thus stretched between said transfer stop (33) (point C) and the front point (10) (point A) where the platform (2) is attached onto the ski (1).

Of course, replacing this transverse stop (33) by an equivalent articulation fork would not depart from the scope of the invention.

Third Embodiment of the Invention

Figure 9:
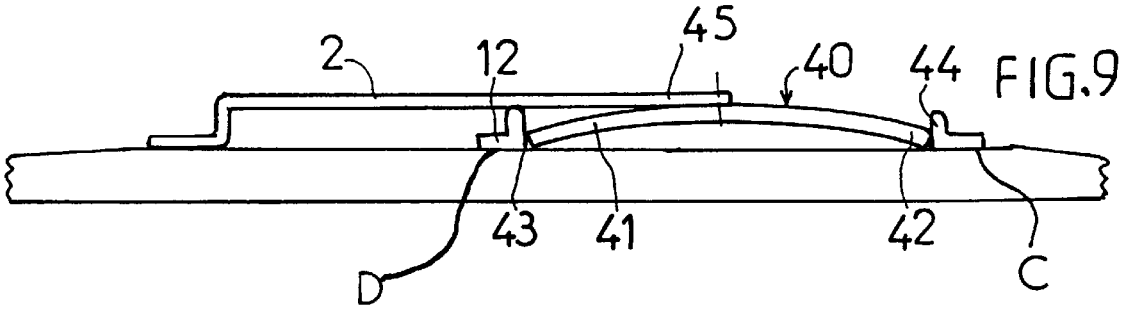
FIGS. 9 and 10 are side views of a third embodiment principle of the invention in two different forms.

It is also possible to tension the ski solely in a restricted region close to the support region. The embodiment described in FIG. 9 shows a platform (2) having an arc (40), formed by a leaf spring, arranged under its rear region (45). The front (41) and rear (42) ends of this leaf spring (40) bear on two transverse stops (43, 44) arranged respectively to the front and to the rear of these ends.

In this way, with rear pressure (F2) , the rear end (45) of the platform compresses this leaf spring (40) , the front (41) and rear (42) ends of which push the transverse stops (43, 44) apart, which tensions the ski in the region contained between said stops (43, 44).

Figure 10:
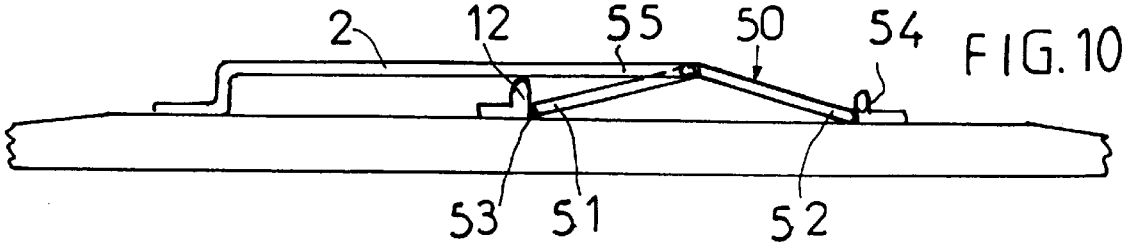

Of course, replacing this leaf spring by a set of arms forming a forked joint, optionally articulated onto the rear end of the platform (see FIG. 10), would not depart from the scope of the invention.

The above description shows that the intermediate stiffener device installed on gliding boards according to the invention advantageously makes it possible to modify the stiffness of the ski dynamically as a function of the variation in the position of the skier's pressure.

Thus, when initiating turns, when the pressure lies to the front, the ski keeps its natural flexibility. In contrast, at the end of turns, when the pressure is oriented more toward the rear of the ski, the device according to the invention makes it possible to tension the support region of the ski and therefore stiffen it.

This increase in stiffness makes it easier to run and makes the conclusion of the turn more stable and therefore more comfortable.

I claim:

1. A gliding board having a lower gliding face and an upper face intended, in a binding and boot support region, to accommodate a binding for securing a user's boot to the board, the board being, in the support region, equipped with a stiffener device for modifying the stiffness of the board under the effect of a thrust exerted by a user toward the upper face of the board, wherein the stiffener device comprises:

an elongate upper platform to accommodate a binding on an upper face of the platform, a front end of said platform being secured to a bearing point linked to the board;

a rigid and nondeformable intermediate stud of fixed height located between a lower face of the platform and the upper face of the board;

means for tensioning at least one part of the board under the action of a vertical thrust exerted by a user only in a rear region of the platform, wherein the action of a vertical thrust exerted by a user in a front region of the platform does not tension any part of the board.

2. The gliding board as claimed in claim 1, wherein the front end (10) of the platform is fixed on the upper face of the board.

3. The gliding board as claimed in claim 1, wherein the front end of the platform is mounted articulated relative to the upper face of the board.

4. The gliding board as claimed in claim 1, wherein the rigid stud is secured to the upper face of the board, and wherein the lower face of the platform can slide on the stud.

5. The gliding board as claimed in claim 1, wherein the stud is secured to the lower face of the platform, and wherein the stud can slide on the upper face of the board.

6. The gliding board as claimed in claim 1, wherein the intermediate stud is located substantially at the middle of the support region.

7. The gliding board as claimed in claim 1, which includes an elastic return element interposed between the upper face of the board and the lower face of the platform, to the rear of the intermediate stud.

8. The gliding board as claimed in claim 1, wherein the means for tensioning a part of the board comprises a set of cams located respectively under the lower face of the platform and on the upper face of the board, said cams having camming surfaces oriented downward and toward the front of the board, to cause the bearing point of the front of the platform to move away from the cams, under the effect of a thrust, perpendicular to the surface of the board, exerted in the rear region of the platform.

9. The gliding board as claimed in claim 8, wherein at least one of the cams consists of an inclined slope.

10. The gliding board as claimed in claim 8, wherein the inclination of the inclined slope 30 relative to the upper face of the board is between 30° and 60°.

11. The gliding board as claimed in claim 10 wherein the inclination is about 45°.

12. The gliding board as claimed in claim 8, wherein one of the camming surfaces consists of a cylindrical roller with an axis of revolution perpendicular to the longitudinal mid-plane of the board.

13. The gliding board as claimed in claim 8, wherein the camming surfaces are covered with a coating reducing the coefficient of friction.

14. The gliding board as claimed in claim 1, which includes a stop which can limit displacement of the rear region of the platform upward and rearward.

15. The gliding board as claimed in claim 14, which comprises a strip of viscoelastic material interposed between the stop and the rear region of the platform.

16. The gliding board as claimed in claim 1, wherein the means for tensioning a part of the board consist of an arm located at the rear of the platform, the front end of the arm is articulated to the rear of the platform, the rear end of the arm bearing on a fixed point of the upper face of the board and pushing it back under the effect of a vertical thrust exerted in the rear region of the platform.

17. The gliding board as claimed in claim 16, wherein the rear end of the arm is articulated onto the upper face of the board.

18. The gliding board as claimed in claim 16, wherein the means for tensioning a part of the platform also comprise a second arm, forming a hinged fork with the first arm, the front end of the second arm bearing on a second fixed point of the upper face of the board, the two fixed points being moved away from one another under the effect of a vertical thrust (F2) exerted in the rear region of the platform.

* * * * *